US012704301B2

(12) United States Patent
Liu et al.

(10) Patent No.: US 12,704,301 B2
(45) Date of Patent: Aug. 11, 2026

(54) REFRIGERATION SYSTEM AND THE CONTROL METHOD THEREOF

(71) Applicant: Carrier Corporation, Palm Beach Gardens, FL (US)

(72) Inventors: Hongsheng Liu, Shanghai (CN); Jichao Hu, Shanghai (CN); Xinglei Zhang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 285 days.

(21) Appl. No.: 18/165,655

(22) Filed: Feb. 7, 2023

(65) Prior Publication Data

US 2023/0258377 A1 Aug. 17, 2023

(30) Foreign Application Priority Data

Feb. 11, 2022 (CN) ..... 202210128771.3

(51) Int. Cl.
*F25B 41/40* (2021.01)
*F25B 13/00* (2006.01)
*F25B 43/00* (2006.01)

(52) U.S. Cl.
CPC ..... *F25B 41/40* (2021.01); *F25B 13/00* (2013.01); *F25B 43/006* (2013.01); *F25B 2400/13* (2013.01); *F25B 2500/18* (2013.01)

(58) Field of Classification Search
CPC ..... F25B 41/40; F25B 40/00; F25B 13/00; F25B 43/006; F25B 2400/13; F25B 2500/18
See application file for complete search history.

(56) References Cited

U.S. PATENT DOCUMENTS 9,372,014 B2 6/2016 Nagano et al.
2012/0291462 A1 11/2012 Verma et al.
(Continued)

FOREIGN PATENT DOCUMENTS

JP 4915250 B2 * 4/2012

OTHER PUBLICATIONS

Fujiwara et al. (JP4915250B2), English Translation, Ejector Type Refrigeration Cycle, Whole Document (Year: 2012).*
(Continued)

*Primary Examiner* — Jerry-Daryl Fletcher
*Assistant Examiner* — Keith Stanley Myers
(74) *Attorney, Agent, or Firm* — CANTOR COLBURN LLP

(57) ABSTRACT

A refrigeration system and a control method thereof. The refrigeration system includes a compressor and a condenser, and further includes a first throttling device for receiving liquid refrigerant from the condenser; an ejector having a high-pressure fluid inlet, a fluid suction inlet and a fluid outlet, the high-pressure fluid inlet of the ejector is connected to the first throttling device, the fluid outlet of the ejector is connected to a flash tank, a gas-phase outlet of the flash tank is connected to a compressor inlet, a liquid-phase outlet of the flash tank is connected to an evaporator via a second throttling device, and the evaporator is connected to the fluid suction inlet of the ejector; and a controller configured to control an opening of the first throttling device based on a pressure difference between the fluid outlet and the fluid suction inlet of the ejector.

13 Claims, 2 Drawing Sheets

(56) References Cited

U.S. PATENT DOCUMENTS

| | | | | |
|---|---|---|---|---|
| 2013/0042640 | A1* | 2/2013 | Higashiiue | F25B 41/00 29/890.035 |
| 2013/0111944 | A1* | 5/2013 | Wang | F25B 43/006 62/500 |
| 2013/0125569 | A1 | 5/2013 | Verma et al. | |
| 2017/0321941 | A1* | 11/2017 | Fredslund | F25B 41/39 |
| 2018/0328638 | A1* | 11/2018 | Mahmoud | F25B 41/20 |

OTHER PUBLICATIONS

Allen, Transcritical CO2 Refrigeration Basics and Benefits, Super Radiator Coils, Whole Document (Year: 2020).*

European Search Report for Application No. 23156181.2, Issued Jun. 21, 2023, 8 Pages.

* cited by examiner

REFRIGERATION SYSTEM AND THE CONTROL METHOD THEREOF

FOREIGN PRIORITY

This application claims priority to Chinese Patent Application No. 202210128771.3, filed Feb. 11, 2022, and all the benefits accruing therefrom under 35 U.S.C. § 119, the contents of which in its entirety are herein incorporated by reference.

TECHNICAL FIELD OF INVENTION

The present invention relates to the field of refrigeration systems, in particular to a refrigeration system and a control method thereof applied in a case where there is a significant difference between the ambient temperature and the target temperature.

BACKGROUND OF THE INVENTION

A refrigeration system with an Enhanced Vapor Injection (EVI) compressor is often used when the outdoor temperature is relatively low, e.g., −25° C. to −15° C. When the outdoor temperature is extremely low, the heat exchange capacity of the outdoor unit goes down, the return gas quantity of the normal gas return port of the compressor decreases, and the compressor power is reduced, thus the best effect cannot be achieved. The EVI compressor supplements the refrigeration gas through a middle pressure return gas injection port, so that the exhaust amount of the compressor is increased, and the amount of circulating refrigeration of the heat exchanger of the indoor unit for heating is increased, thus increasing heat generation. Compared with the single-stage compressor, this compressor improves the system efficiency and operating temperature range. For example, the heating capacity of this kind of system can be increased by about 20%-50% at −15° C. However, when the evaporation temperature is below −30° C. or the ambient temperature is below −25° C., or when the temperature difference between the ambient temperature and the target temperature is significant, for example, greater than 40° C., even the refrigeration system with an EVI compressor is difficult to cope with such condition, so its efficiency will be significantly reduced.

SUMMARY OF THE INVENTION

The object of the present application is to solve or alleviate the problems existing in the prior art.

According to one aspect, a refrigeration system is provided, comprising a compressor and a condenser, and further comprising:

- a first throttling device for throttling liquid refrigerant from the condenser to produce gas-liquid two-phase refrigerant;
- an ejector having a high-pressure fluid inlet, a fluid suction inlet and a fluid outlet, wherein the high-pressure fluid inlet of the ejector is connected to the first throttling device to receive the gas-liquid two-phase refrigerant, the fluid outlet of the ejector is connected to a flash tank, the gas-phase outlet of the flash tank is connected to the compressor inlet, the liquid-phase outlet of the flash tank is connected to an evaporator via a second throttling device, and the evaporator is connected to the fluid suction inlet of the ejector; and

- a controller configured to control the opening of the first throttling device based on the pressure difference between the fluid outlet and the suction fluid inlet of the ejector.

Optionally, in an embodiment of the refrigeration system, pressure sensors are respectively provided at or upstream the fluid suction inlet of the ejector and at or downstream the fluid outlet of the ejector to sense the pressure difference, or the controller is configured to control the opening of the first throttling device based on the dryness of the gas-liquid two-phase refrigerant and the relationship between the dryness and the pressure difference. Wherein, the refrigeration system comprises a dryness sensor 109 that directly senses the dryness of the gas-liquid two-phase refrigerant, or the refrigeration system comprises a first pressure sensor and a first temperature sensor upstream of the first throttling device and a second pressure sensor or a second temperature sensor downstream of the first throttling device. The controller calculates the dryness of the gas-liquid two-phase refrigerant downstream of the first throttling device based on the temperature and pressure of the refrigerant upstream of the first throttling device and the temperature or pressure of the refrigerant downstream of the first throttling device.

Optionally, in an embodiment of the refrigeration system, the compressor is an EVI compressor, wherein the compressor outlet is connected to the condenser, and the condenser is connected to a first pipeline of an economizer. The upstream or downstream of the economizer branches into a first path leading to the first throttling device and a second path leading to a second pipeline of the economizer via another throttling device and then connected to a gas supply port of the EVI compressor.

Optionally, in an embodiment of the refrigeration system, the compressor is an EVI compressor, wherein the compressor outlet is connected to the condenser, and the condenser is connected to a second flash tank via a third throttling device, where the liquid-phase outlet of the second flash tank is connected to the first throttling device, and the gas-phase outlet of the second flash tank is connected to the gas supply port of the EVI compressor.

Optionally, in an embodiment of the refrigeration system, the first throttling device is an electronic expansion valve, and the controller is configured to control the opening of the electronic expansion valve such that the gas-liquid two-phase refrigerant downstream of the first throttling device has a dryness of 0.05 to 0.5 and, optionally, the gas-liquid two-phase refrigerant downstream of the first throttling device has a dryness of 0.08 to 0.3.

Optionally, in an embodiment of the refrigeration system, the refrigeration system employs a subcritical refrigerant, such as R410A refrigerant, and the controller is configured to control the opening of the first throttling device such that the gas-liquid two-phase refrigerant downstream of the first throttling device has a dryness of 0.08 to 0.2.

Optionally, in an embodiment of the refrigeration system, the refrigeration system employs a trans-critical refrigerant, such as CO2 refrigerant, and the controller is configured to control the opening of the first throttling device such that the gas-liquid two-phase refrigerant downstream of the first throttling device has a dryness of 0.15 to 0.3.

According to another aspect, a control method for the refrigeration system according to the aforementioned embodiments is provided, which comprises:

- passing refrigerant liquid condensed by the condenser through an economizer or a flash tank; and
- throttling the refrigerant liquid passing through the economizer or flash tank by a throttling device before entering an ejector to produce gas-liquid two-phase refrigerant, and controlling the opening of the first throttling device based on a pressure difference between the fluid outlet and the fluid suction inlet of the ejector.

Optionally, the method also comprises controlling the opening of the first throttling device based on the dryness of the gas-liquid two-phase refrigerant and the relationship between the dryness and the pressure difference, wherein the method comprises directly sensing the dryness of the gas-liquid two-phase refrigerant, or the method comprises calculating the dryness of gas-liquid two-phase refrigerant downstream of the first throttling device based on the temperature and pressure of the refrigerant upstream of the first throttling device and the temperature or pressure of the refrigerant downstream of the first throttling device.

Optionally, the method comprises allowing the dryness of the gas-liquid two-phase refrigerant to be in a range of 0.05 to 0.5, or optionally allowing the dryness of the gas-liquid two-phase refrigerant to be in a range of 0.08 to 0.3.

Optionally, the method comprises: employing R410A refrigerant, and allowing the dryness of the gas-liquid two-phase refrigerant to be in a range of 0.08 to 0.2; or employing CO2 refrigerant, and allowing the dryness of the gas-liquid two-phase refrigerant to be in a range of 0.15 to 0.3.

The refrigeration system and method according to the present invention can operate efficiently at extremely low ambient temperatures or in a case where there is a large temperature difference between the ambient temperature and the target temperature. For example, the limitation of the Enhanced Vapor Injection (EVI) compression technology is that it is difficult to operate at ambient temperatures below −25° C. The embodiments of the present invention allows the EVI compressor system to operate at ambient temperatures ranging from −25° C. to −30° C. and below, i.e., further improving the efficiency and operating temperature range of the EVI system.

BRIEF DESCRIPTION OF THE DRAWINGS

With reference to the accompanying drawings, the disclosure of the present application will become easier to understand. Those skilled in the art would easily understand that these drawings are for the purpose of illustration, and are not intended to limit the protection scope of the present application. In addition, in the figures, similar numerals are used to denote similar components, where.

DETAILED DESCRIPTION OF THE INVENTION

Figure 1:
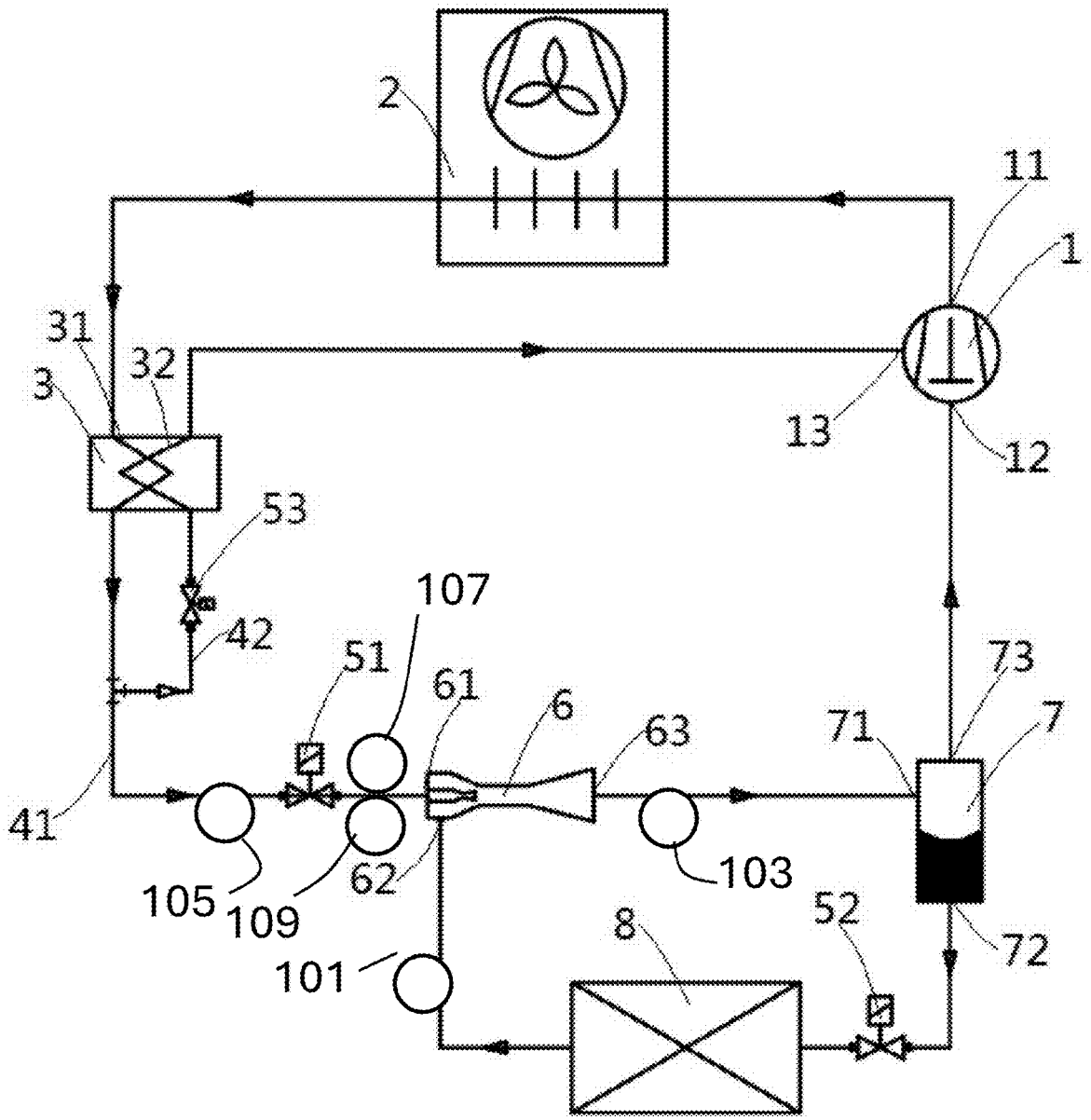
FIG. 1 is a schematic diagram of a refrigeration system according to an embodiment of the present invention.

Referring to FIG. 1, it shows a refrigeration system according to an embodiment of the present invention. The refrigeration system comprises: a compressor 1 comprising a compressor inlet 12 and a compressor outlet 11, a condenser 2, a first throttling device 51 for receiving liquid refrigerant from the condenser 2 and throttling it into gas-liquid two-phase refrigerant, and an ejector loop. The ejector loop comprises: an ejector 6 comprising a high-pressure fluid inlet 61, a fluid suction inlet 62 and a fluid outlet 63, wherein the high-pressure fluid inlet 61 of the ejector is connected to a first throttling device 51, the fluid outlet 63 of the ejector is connected to a flash tank 7, the gas-phase outlet 73 of the flash tank 7 is connected to the compressor inlet 12, the liquid-phase outlet 72 of the flash tank 7 is connected to an evaporator 8 via a second throttling device 52, and the evaporator 8 is connected to the fluid suction inlet 62 of the ejector. The first throttling device 51 is connected to a controller (not shown), wherein the controller is configured to control the opening of the first throttling device based on the pressure difference between the fluid outlet and the fluid suction inlet of the ejector. When the pressure difference is lower than a preset value, the opening of the first throttling device is reduced, and when the pressure difference is higher than the preset value, the opening of the first throttling device is increased, so as to ensure the efficient operation of the ejector. In some embodiments, the pressure difference can be sensed directly by sensors, e.g., pressure sensors 101 and 103 are provided respectively at or upstream the fluid suction inlet of the ejector and at or downstream the fluid outlet of the ejector to sense the pressure difference. In other embodiments, said control is depending on the state of the two-phase refrigerant entering the high-pressure fluid inlet of the ejector, such as its dryness. The so-called dryness refers to the proportion of the mass of gas-phase refrigerant to the mass of gas-liquid two-phase refrigerant in the refrigerant, which determines the pressure rise of the ejector. Efficient operation of the ejector can be ensured when the dryness of the refrigerant is controlled in a proper range. According to the embodiments of the present invention, the refrigerant is converted into gas-liquid two phases by the first throttling device 51 and the dryness of the refrigerant is controlled so that the ejector system can still be effectively driven when the liquid refrigerant supercooling is too high, thereby improving the system performance, especially at low ambient temperatures or when the temperature difference between the ambient temperature and the target temperature is large. More specifically, by means of a device according to the embodiments of the present invention, the efficiency of the refrigeration system can be increased, e.g., by 5% to 10% at ambient temperatures of −15° C. to −30° C. (or even lower). In other words, the efficiency of the refrigeration system can be increased, e.g., by 5% to 10% at evaporation temperatures of −20° C. to −35° C. (or even lower). On the other hand, the operating temperature range of the refrigeration system can be increased, e.g., extending to lower temperature limit by 5° C. to 10° C.

In some embodiments, the dryness of the refrigerant can be measured directly by sensors. In other embodiments, the refrigeration system may comprise a first pressure sensor and a first temperature sensor 105 upstream of the first throttling device 51 and a second pressure sensor or a second temperature sensor 107 downstream of the first throttling device 51. The controller calculates the dryness of the gas-liquid two-phase refrigerant downstream of the first throttling device based on the temperature and pressure of the refrigerant upstream of the first throttling device 51 and the temperature or pressure of the refrigerant downstream of the first throttling device 51. It should be appreciated that the refrigerant downstream of the first throttling device 51 is saturated and its temperature and pressure are of a corresponding relationship, so that when one of them is measured, the other can be calculated, so as to calculate the dryness of the refrigerant. In some embodiments, the controller can dynamically adjust the opening of the first throttling device 51 by setting a threshold value in a certain dryness range and comparing the actually measured or calculated value with the threshold value. For example, when the dryness is greater than the threshold value, the opening of the first throttling device 51 is appropriately increased, and when the dryness is less than the threshold value, the opening of the first throttling device 51 is appropriately reduced.

In some embodiments, the compressor 1 is an EVI compressor comprising a compressor inlet 12, a compressor outlet 11, and a gas supply port 13. The compressor outlet 11 is connected to the condenser 2, the condenser 2 is connected to a first pipeline 31 of the economizer 3, and the downstream of the economizer branches into a first path 41 leading to the first throttling device 51 and a second path 42 leading to a second pipeline 32 of the economizer 3 via another throttling device 53 and then connected to the gas supply port 13 of the EVI compressor 1. In an alternative embodiment, it is also possible that the upstream of the economizer 3 branches into the first path and the second path. The cooperation between the EVI compressor and the ejector loop enables the refrigeration system to cope with lower ambient temperatures or greater temperature differences between the ambient and target temperatures. It should be appreciated that since the liquid refrigerant condensed in the EVI compressor system has increased supercooling as it passes through the economizer, the liquid refrigerant with high supercooling cannot efficiently drive the ejector loop. Whereas, gas-liquid two-phase refrigerant can be produced by throttling by the first throttling device 51 and related controls, which can effectively drive the ejector loop to improve the efficiency of the refrigeration system at low ambient temperatures.

In some embodiments, the controller is configured to control the opening of the first throttling device 51 such that the refrigerant downstream of the first throttling device 51 is a gas-liquid two-phase refrigerant with a dryness of 0.05 to 0.5. In some embodiments, the first throttling device 51 is an electronic expansion valve, and the controller is configured to control the opening of the electronic expansion valve 51 such that the gas-liquid two-phase refrigerant downstream of the electronic expansion valve has a dryness of 0.08 to 0.3. In some embodiments, the refrigeration system employs a sub-critical refrigerant, such as R410A refrigerant, and the controller is configured to control the opening of the first throttling device 51 such that the gas-liquid two-phase refrigerant downstream of the first throttling device has a dryness of 0.08 to 0.2. In some embodiments, the refrigeration system employs a trans-critical refrigerant, such as CO2 refrigerant, and the controller is configured to control the opening of the first throttling device 51 such that the gas-liquid two-phase refrigerant downstream of the first throttling device 51 has a dryness of 0.15 to 0.3. The ejector loop can be operated more efficiently by configuring the first throttling device 51 based on different refrigerants.

Figure 2:
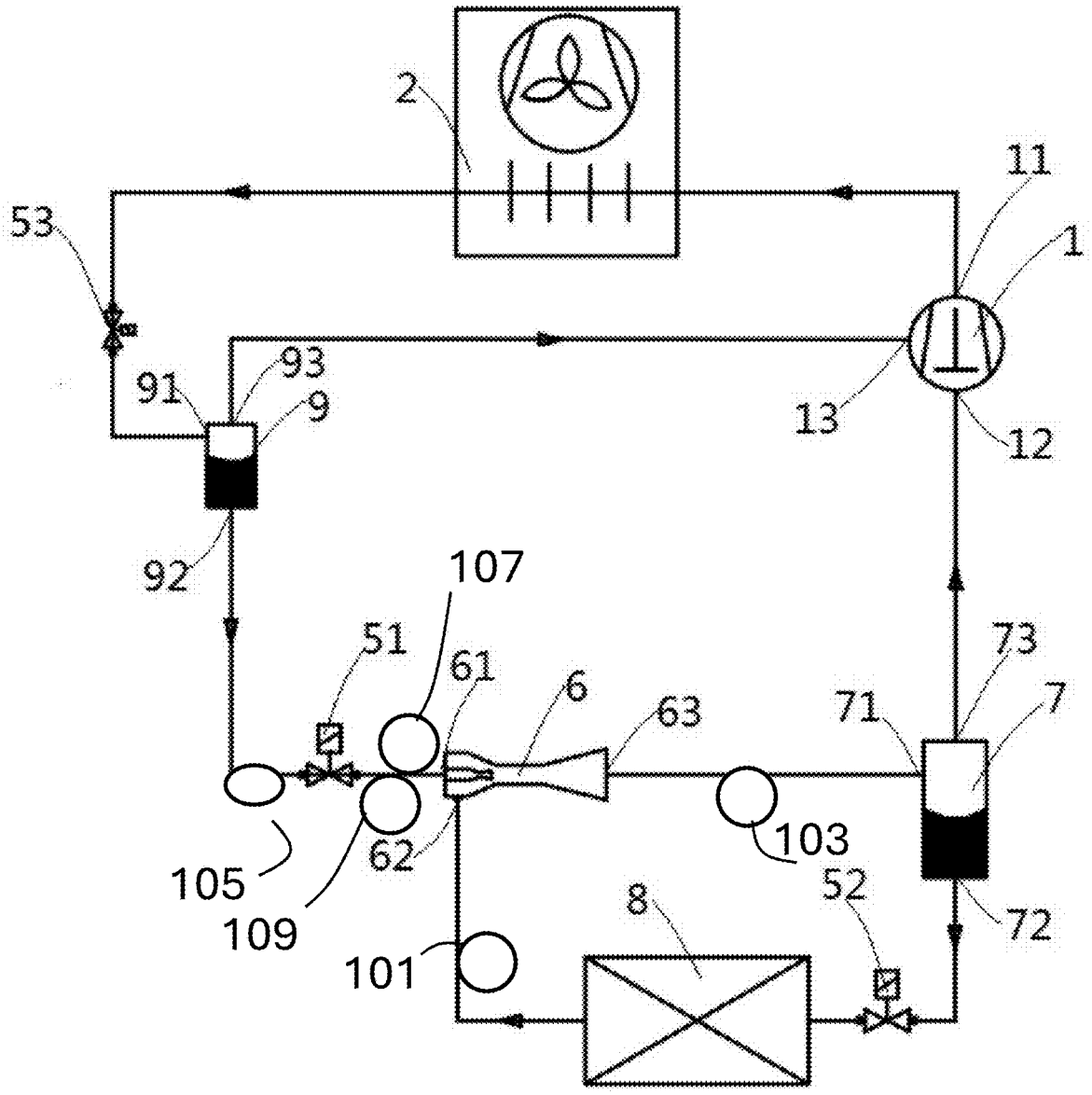
FIG. 2 is a schematic diagram of a refrigeration system according to another embodiment of the present invention.

With continued reference to FIG. 2, it shows another refrigeration system with an EVI compressor. In this embodiment, the compressor outlet 11 is connected to the condenser 2, the condenser 2 is connected to a second flash tank 9 via a third throttling device 53, the liquid-phase outlet 92 of the second flash tank 9 is connected to the first throttling device 51, and the gas-phase outlet of the second flash tank 93 is connected to the gas supply port 13 of the EVI compressor. The refrigeration system shown in FIG. 2 can be applied to a refrigeration system with larger unit scale, such that the refrigeration system can cope with lower ambient temperatures or a larger indoor-outdoor temperature difference. In the refrigeration system shown in FIG. 2, similarly, the two-phase refrigerant produced from the condensed refrigerant passing through the second flash tank and throttled by the first throttling device 51 can drive the ejector loop more efficiently. The opening of the first throttling device 51 can be controlled in the same manner as described in FIG. 1, and be controlled based on the refrigerant in the actual refrigeration system.

According to another aspect, a control method for the refrigeration system according to the embodiments of the present invention is also provided, which comprises: passing the refrigerant liquid condensed by a condenser through an economizer or a flash tank; and throttling the refrigerant liquid passing through the economizer or flash tank by a throttling device before entering an ejector to produce gas-liquid two-phase refrigerant, and controlling the opening of the first throttling device based on a pressure difference between the fluid outlet and the fluid suction inlet of the ejector. In some embodiments, the method also comprises controlling the opening of the first throttling device based on the dryness of the gas-liquid two-phase refrigerant and the relationship between the dryness and the pressure difference. Wherein, the method comprises directly sensing the dryness of the gas-liquid two-phase refrigerant, or the method comprises calculating the dryness of the gas-liquid two-phase refrigerant downstream of the first throttling device based on the temperature and pressure of the refrigerant upstream of the first throttling device and the temperature or pressure of the refrigerant downstream of the first throttling device. In some embodiments, the method comprises controlling the opening of the throttling device so that the dryness of the gas-liquid two-phase refrigerant is in the range of 0.05 to 0.5. In some embodiments, the method comprises allowing the dryness of the gas-liquid two-phase refrigerant to be in the range of 0.08 to 0.3. In some embodiments, the method comprises: employing R410A refrigerant and allowing the gas-liquid two-phase refrigerant to have a dryness of 0.08 to 0.2; or employing CO2 refrigerant, and allowing the gas-liquid two-phase refrigerant to have a dryness of 0.15 to 0.3.

The specific embodiments of the present application described above are merely intended to describe the principles of the present application more clearly, wherein various components are clearly shown or described to facilitate the understanding of the principles of the present invention. Those skilled in the art may, without departing from the scope of the present invention, make various modifications or changes to the present application. Therefore, it should be understood that these modifications or changes should be included within the scope of patent protection of the present application.

What is claimed is:

1. A refrigeration system comprising a compressor and a condenser, and further comprising:

a first throttling device for throttling liquid refrigerant from the condenser to produce gas-liquid two-phase refrigerant;

an ejector having a high-pressure fluid inlet, a fluid suction inlet and a fluid outlet, wherein the high-pressure fluid inlet of the ejector is connected to the first throttling device to receive the gas-liquid two-phase refrigerant, the fluid outlet of the ejector is connected to a flash tank, a gas-phase outlet of the flash tank is connected to a compressor inlet, a liquid-phase outlet of the flash tank is connected to an evaporator via a second throttling device, and the evaporator is connected to the fluid suction inlet of the ejector; and a controller configured to control an opening of the first throttling device based on a sensed pressure difference between the fluid outlet and the fluid suction inlet of the ejector and a dryness of the gas-liquid two-phase refrigerant;

wherein pressure sensors are respectively provided at the fluid suction inlet or upstream the fluid suction inlet of the ejector and at the fluid outlet or downstream the fluid outlet of the ejector to sense the pressure difference, wherein, (i) the refrigeration system comprises a dryness sensor that directly senses the dryness of the gas-liquid two-phase refrigerant, or (ii) the refrigeration system comprises (a) a first pressure sensor and a first temperature sensor upstream of the first throttling device and (b) a second pressure sensor or a second temperature sensor downstream of the first throttling device, and the controller calculates the dryness of the gas-liquid two-phase refrigerant downstream of the first throttling device based on a temperature and a pressure of the refrigerant upstream of the first throttling device and a temperature and a pressure of the refrigerant downstream of the first throttling device.

2. The refrigeration system according to claim 1, wherein the compressor is an Enhanced Vapor Injection compressor, a compressor outlet is connected to the condenser, the condenser is connected to a first pipeline of an economizer, upstream or downstream of the economizer branches into a first path leading to the first throttling device and a second path leading to a second pipeline of the economizer via another throttling device and then connected to a gas supply port of the Enhanced Vapor Injection compressor.

3. The refrigeration system according to claim 1, wherein the compressor is an Enhanced Vapor Injection compressor, the compressor outlet is connected to the condenser, and the condenser is connected to a second flash tank via a third throttling device, where a liquid-phase outlet of the second flash tank is connected to the first throttling device, and a gas-phase outlet of the second flash tank is connected to the gas supply port of the Enhanced Vapor Injection compressor.

4. The refrigeration system according to claim 1, wherein the first throttling device is an electronic expansion valve, and the controller is configured to control an opening of the electronic expansion valve such that gas-liquid two-phase refrigerant downstream of the first throttling device has a dryness of 0.05 to 0.5, the dryness being sensed or computed.

5. The refrigeration system according to claim 4, wherein the refrigeration system employs a subcritical refrigerant and the controller is configured to control the opening of the first throttling device such that the gas-liquid two-phase refrigerant downstream of the first throttling device has a dryness of 0.08 to 0.2.

6. The refrigeration system according to claim 4, wherein the refrigeration system employs a trans-critical refrigerant and the controller is configured to control the opening of the first throttling device such that the gas-liquid two-phase refrigerant downstream of the first throttling device has a dryness of 0.15 to 0.3.

7. The refrigeration system according to claim 4, wherein the controller is configured to control the opening of the electronic expansion valve such that gas-liquid two-phase refrigerant downstream of the first throttling device has a dryness of 0.08 to 0.3.

8. A control method for the refrigeration system according to claim 1, comprising:

passing refrigerant liquid condensed by the condenser through an economizer or a flash tank; and throttling the refrigerant liquid passing through the economizer or flash tank by the first throttling device before entering the ejector to produce gas-liquid two-phase refrigerant, and controlling the opening of the first throttling device based on the sensed pressure difference between the fluid outlet and the fluid suction inlet of the ejector.

9. The control method according to claim 8, wherein the method further comprises controlling the opening of the first throttling device based on the dryness of the gas-liquid two-phase refrigerant and the pressure difference, wherein the method comprises directly sensing the dryness of the gas-liquid two-phase refrigerant, or the method comprises calculating the dryness of gas-liquid two-phase refrigerant downstream of the first throttling device based on the temperature and the pressure of the refrigerant upstream of the first throttling device and the temperature or the pressure of the refrigerant downstream of the first throttling device.

10. The control method according to claim 8, wherein the method comprises controlling a dryness of the gas-liquid two-phase refrigerant to be in a range of 0.05 to 0.5.

11. The control method according to claim 10, wherein the method comprises controlling the dryness of the gas-liquid two-phase refrigerant to be in a range of 0.08 to 0.3.

12. The control method according to claim 10, wherein the method comprises employing a subcritical refrigerant and controlling the dryness of the gas-liquid two-phase refrigerant to be in a range of 0.08 to 0.2.

13. The control method according to claim 10, wherein the method comprises employing a trans-critical refrigerant and controlling the dryness of the gas-liquid two-phase refrigerant to be in a range of 0.15 to 0.3.

* * * * *